US008814299B2

(12) United States Patent
Tanaka et al.

(10) Patent No.: US 8,814,299 B2
(45) Date of Patent: Aug. 26, 2014

(54) FLUID DISCHARGE DEVICE, NOZZLE INSPECTION METHOD, AND MEDIUM ON WHICH NOZZLE INSPECTION PROGRAM IS RECORDED

(75) Inventors: Ryoichi Tanaka, Nagano (JP); Noriaki Yamashita, Nagano (JP); Teruaki Kaieda, Nagano (JP); Ryosuke Tsuchihashi, Nagano (JP); Hirokazu Nunokawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 149 days.

(21) Appl. No.: 13/455,706

(22) Filed: Apr. 25, 2012

(65) Prior Publication Data

US 2012/0287186 A1 Nov. 15, 2012

(30) Foreign Application Priority Data

May 11, 2011 (JP) ..... 2011-105927

(51) Int. Cl.

| | |
|---|---|
| ***B41J 29/38*** | (2006.01) |
| ***B41J 29/393*** | (2006.01) |
| ***B41J 2/045*** | (2006.01) |
| ***B41J 2/165*** | (2006.01) |

(52) U.S. Cl.

CPC ..... *B41J 2/16526* (2013.01); *B41J 2/0459* (2013.01); *B41J 2/04578* (2013.01); *B41J 2/04573* (2013.01); *B41J 2/16579* (2013.01); *B41J 2/0451* (2013.01); *B41J 2/0458* (2013.01); *B41J 2/16508* (2013.01); *B41J 2/04581* (2013.01); *B41J 2/04553* (2013.01); *B41J 2/04588* (2013.01)

USPC ..... 347/10; 347/12; 347/14; 347/19

(58) Field of Classification Search

USPC ..... 347/10, 12, 19, 14

See application file for complete search history.

(56) References Cited

U.S. PATENT DOCUMENTS

| | | | | |
|---|---|---|---|---|
| 2004/0165038 | A1* | 8/2004 | Garbacz et al. | 347/73 |
| 2007/0229578 | A1* | 10/2007 | Yokozawa et al. | 347/23 |
| 2008/0136853 | A1* | 6/2008 | Kinoshita | 347/12 |
| 2009/0213168 | A1 | 8/2009 | Ito | |
| 2011/0211011 | A1* | 9/2011 | Hoshi et al. | 347/19 |

FOREIGN PATENT DOCUMENTS

| | | | |
|---|---|---|---|
| JP | 2009-196291 | A | 9/2009 |
| JP | 2009-226616 | A | 10/2009 |
| JP | 2009-226619 | A | 10/2009 |
| JP | 2009-226620 | A | 10/2009 |
| JP | 2010-179543 | A | 8/2010 |

* cited by examiner

*Primary Examiner* — Sarah Al Hashimi
(74) *Attorney, Agent, or Firm* — Global IP Counselors, LLP

(57) ABSTRACT

To reduce the number of nozzles in an unstable state after a nozzle inspection, a fluid discharge device includes a discharge head capable of discharging a fluid from nozzle, a nozzle inspection process for inspecting a state of discharging of the fluid from the nozzle, and a controller for subjecting the nozzle to a pre-process for discharging the fluid under a discharge condition that a nozzle in an unstable state be put into a dot omission state, subsequently discharging the fluid for the sake of inspection, and executing an inspection process by the nozzle inspection part.

7 Claims, 10 Drawing Sheets

"DOT OMISSION STATE"

FLUID DISCHARGE DEVICE, NOZZLE INSPECTION METHOD, AND MEDIUM ON WHICH NOZZLE INSPECTION PROGRAM IS RECORDED

CROSS-REFERENCE TO RELATED APPLICATIONS

This application claims priority to Japanese Patent Application No. 2011-105927 filed on May 11, 2011. The entire disclosure of Japanese Patent Application No. 2011-105927 is hereby incorporated herein by reference.

BACKGROUND

1. Technical Field

The present invention relates to a fluid discharge device for discharging a fluid from nozzles, a nozzle inspection method, and a medium on which a nozzle inspection program is recorded.

2. Background Technology

In inkjet printers and other fluid discharge devices, nozzles are inspected based on voltage changes caused by ink discharged from the nozzles, and in cases such as when the nozzles omit dots, a cleaning process or another restorative process is executed as maintenance. Possible examples of the cause of ink not being discharged normally from the nozzles include the surface of ink (the meniscus) exposed in the nozzles being open to the atmosphere, causing the solvent to evaporate and the ink to thicken; and air bubbles getting into the pressure-generating chambers or the like, in which case the pressure changes in the pressure-generating chambers are absorbed by the air bubbles. Therefore, when nozzles that do not normally discharge ink are detected in the discharge inspection process, a restorative process is performed on the nozzles in order to restore the nozzles to the normal state.

For example, in the fluid discharge device disclosed in Patent Citation 1, cleaning boxes are provided, one for each of a plurality of nozzle rows, electrodes are disposed on the cleaning boxes, and the electrodes connected to means for detecting voltage changes caused by fluid discharged from the nozzles are switched to determine whether or not fluid has been discharged. A cleaning process is executed for nozzle rows determined to have not discharged fluid.

In the fluid discharge device disclosed in Patent Citation 2, when a nozzle inspection is performed, a print head is controlled so that ink droplets are discharged from the nozzles into a cap, and a determination of whether or not ink droplets have been discharged normally from the nozzles is made by comparing a threshold and a voltage signal derived from a differential between voltage signals from electrodes that have caused ink droplets to be discharged from among the plurality of electrodes, and voltage signals from electrodes that have not caused ink droplets to be discharged.

In the fluid discharge device disclosed in Patent Citation 3, when an uninspectable state has been detected, wherein the inspection means for inspecting whether or not there are any problematic nozzles cannot obtain the necessary inspection precision, the gap between a discharge means and an inspection electrode is adjusted to a width such that the inspection means can transition to an inspectable state.

In the fluid discharge device disclosed in Patent Citation 4, the peak values of voltage signals inputted from electrodes are held, the held peak values are added, and when a nozzle inspection is commanded, the print head is controlled so that a predetermined number of droplets are discharged from the nozzles, and the state of discharge of the nozzles is determined along with this control on the basis of the value obtained by adding the peak values.

In the fluid discharge device disclosed in Patent Citation 5, a print head is driven so that ink is discharged from any nozzle with a timing of an interval time period when nozzle inspection is performed, that is, a timing whereby a counter waveform is generated for negating a residual waveform which follows the main signal waveform of electrical changes.

Japanese Laid-open Patent Publication No. 2009-226616 (Patent Document 1), Japanese Laid-open Patent Publication No. 2009-226620 (Patent Document 2), Japanese Laid-open Patent Publication No. 2009-196291 (Patent Document 3), Japanese Laid-open Patent Publication No. 2009-226619 (Patent Document 4), and Japanese Laid-open Patent Publication No. 2010-179543 (Patent Document 5), are examples of the related art.

SUMMARY

When the state of the nozzles is not normal, in addition to the dot omission state in which fluid is not discharged from the nozzles, there are unstable states such as the discharge direction of the fluid being unstable, and the discharged quantity of fluid decreasing. When the voltage change or another electrical change caused by fluid discharged from the nozzles is greater than a threshold, sometimes nozzles in an unstable state are determined to be in a normal state, maintenance is not performed, the nozzles in an unstable state are used in printing, and the print quality decreases.

In view of the foregoing, it is an advantage of the present invention to reduce nozzles that are in an unstable state after nozzle inspection.

To achieve one of the aforementioned advantages, the present invention according to one aspect includes:

a discharge head capable of discharging a fluid from nozzle;

a nozzle inspection part for inspecting the state of discharging of the fluid from the nozzle; and a controller for subjecting the nozzle to a pre-process for discharging the fluid under a discharge condition that a nozzle in an unstable state be set in a dot omission state, subsequently discharging the fluid for the sake of inspection, and executing an inspection process using the nozzle inspection part.

Specifically, since a nozzle in an unstable state is put into a dot omission state by the pre-process before the inspection process and the inspection process is then performed, the nozzle in an unstable state undergoes maintenance after the nozzle inspection. Since fewer nozzles are in an unstable state after the nozzle inspection, the present aspect can suppress nozzles in an unstable state from being used in printing.

The fluid discharge device described above can be provided merely to a printer, or to a printer and an external device together, for example.

The dot omission state includes a clogged state in which no fluid is discharged from the nozzle.

The inspection of the fluid discharged state includes detecting whether or not the nozzle is in a normal state; detecting which state among a normal state, a dot omission state, and an unstable state the nozzle is in; and the like.

The discharge head can have a drive element for causing fluid to be discharged from the nozzle in accordance with a drive pulse. The discharge condition can be a condition that the drive element be supplied with a pre-process drive pulse of a drive voltage higher than a drive voltage of a recording drive pulse used in discharging of a fluid on a recording medium (designated as condition 1). Since the pre-process drive pulse having a drive voltage higher than the drive voltage of the recording drive pulse is supplied to the drive element, the present aspect can provide a preferred configuration in which a nozzle in an unstable state is set in a dot omission state and subjected to maintenance after nozzle inspection.

The drive voltage includes an electric potential difference between a maximum electric potential and a minimum electric potential in the drive pulse, an electric potential difference between a maximum electric potential and a steady electric potential immediately before the drive pulse is inputted, and the like.

The discharge condition can be a condition that fluid be discharged at a higher rate than a rate of the fluid discharged on the recording medium (designated as condition 2). Since fluid is discharged from the nozzle at a higher rate than during fluid discharge on the recording medium, the present aspect can provide a preferred configuration in which a nozzle in an unstable state is put into a dot omission state and subjected to maintenance after nozzle inspection.

The discharge condition can be a condition that the drive element be supplied with a pre-process drive pulse having a drive frequency higher than a drive frequency of a recording drive pulse used in fluid discharge on a recording medium (designated as condition 3). Since the pre-process drive pulse having a drive frequency higher than the drive frequency of the recording drive pulse is supplied to the drive element, the present aspect can provide a preferred configuration in which a nozzle in an unstable state is put into a dot omission state and subjected to maintenance after nozzle inspection. The discharge condition can also be a combination of some or all of conditions 1, 2, and 3.

The discharge condition can be a condition which changes according to an environment of the discharge head. Since the discharge condition that a nozzle in an unstable state be put into a dot omission state changes according to the environment of the discharge head, the present aspect can provide a preferred configuration in which a nozzle in an unstable state is put into a dot omission state and subjected to maintenance after nozzle inspection.

The environment of the discharge head includes the temperature of the discharge head, the temperature surrounding the discharge head, the humidity surrounding the discharge head, and other factors.

The aspects described above can be applied to a nozzle inspection device, a print device, a print control device, or a system including these devices; a nozzle inspection method, a fluid discharge method, a print method, or a print control method including steps specified as control steps, for example; a nozzle inspection program, a fluid discharge program, a print program, or a print control program including functions specified as control functions, for example; a medium capable of being read by a computer on which these programs are recorded; or the like.

BRIEF DESCRIPTION OF THE DRAWINGS

Referring now to the attached drawings which form a part of this original disclosure.

DETAILED DESCRIPTION OF EXEMPLARY EMBODIMENTS

(1) Summary of Nozzle Inspection Method

First, a summary of the nozzle inspection method according to an aspect of the present invention is described with reference to FIGS. 1 through 5.

Figure 2:
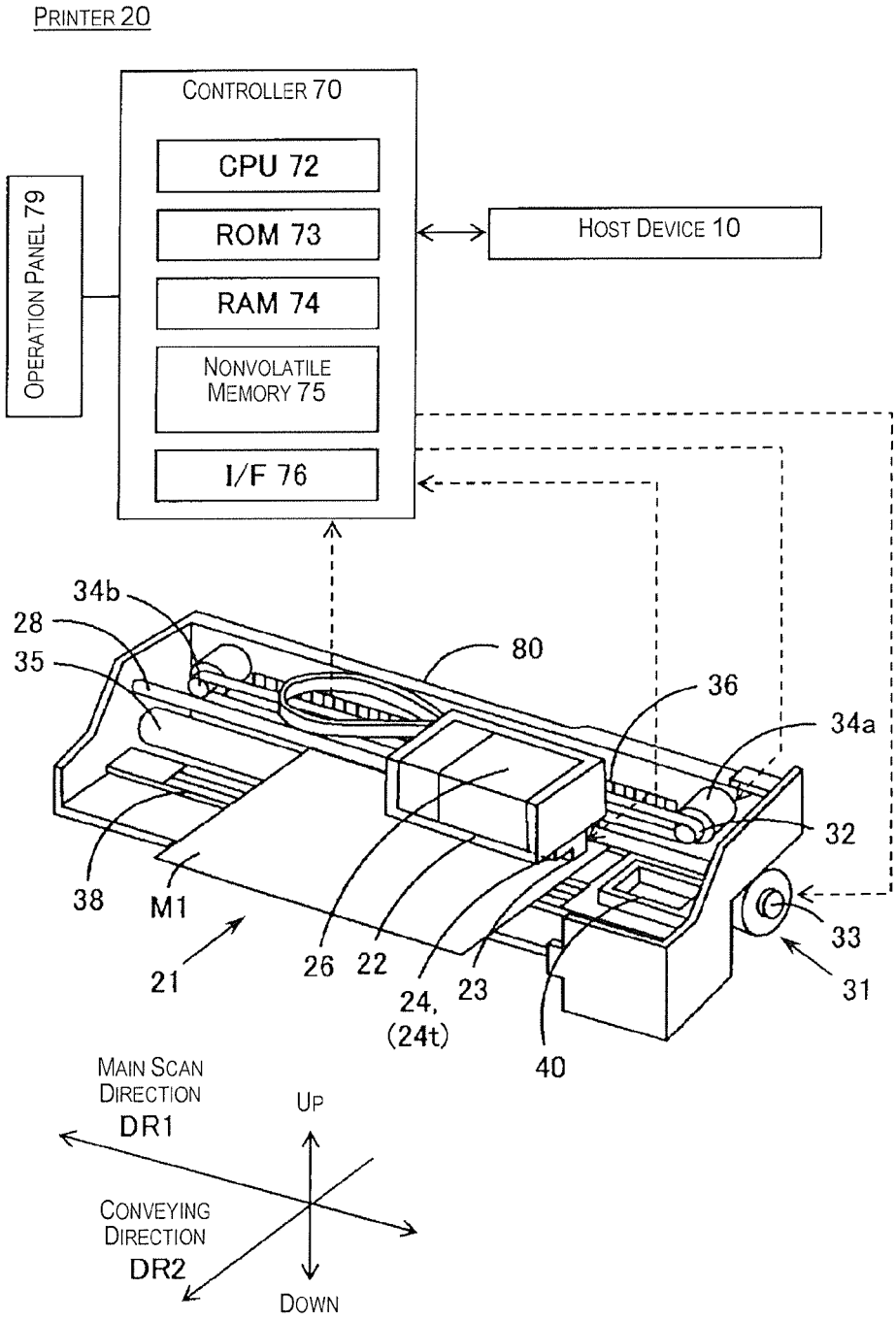
FIG. 2 is a diagram showing an example of the configuration of a printer 20 to which the fluid discharge device according to an embodiment of the present invention has been applied.
Figure 5:
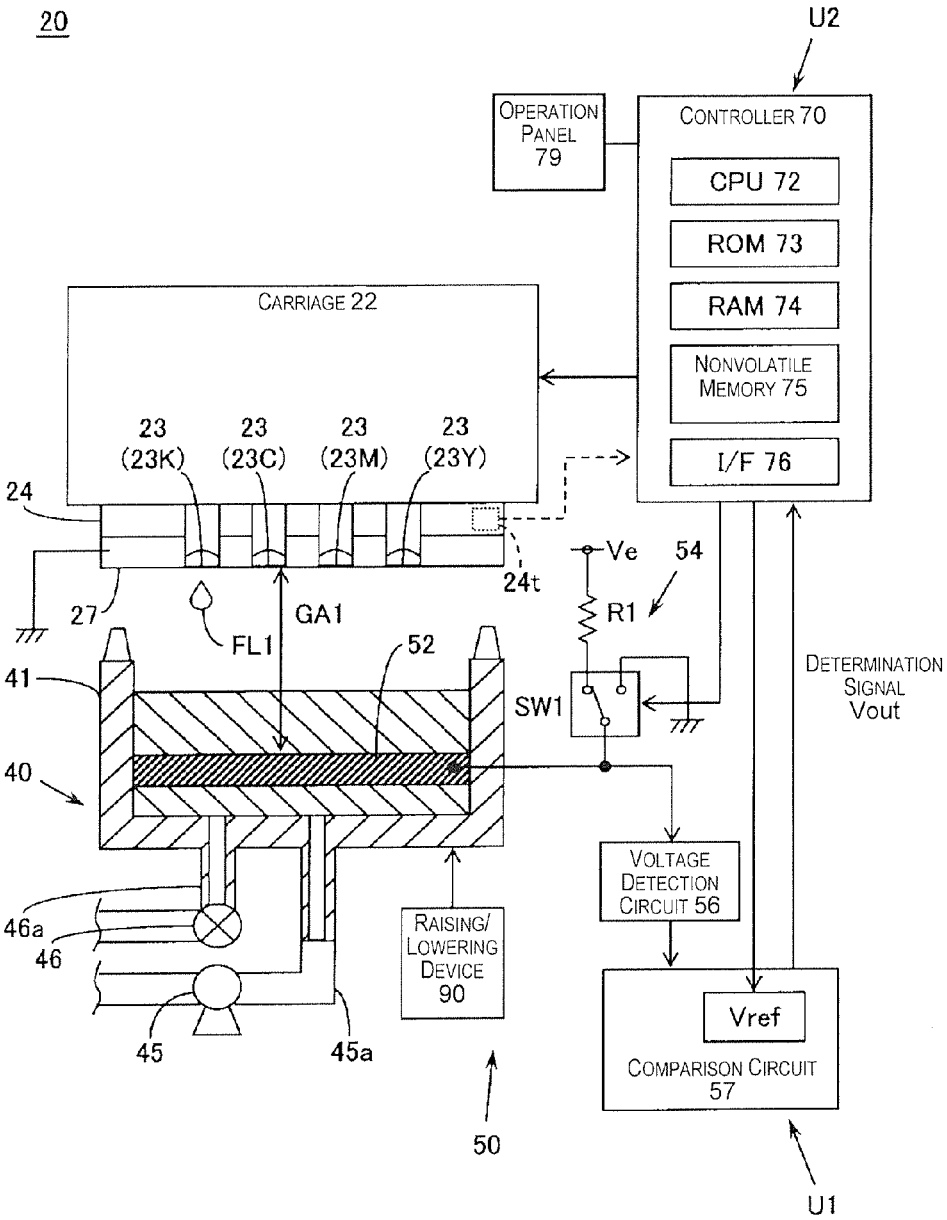
FIG. 5 is a diagram showing an example of a summary of the configuration of the printer 20.

FIGS. 2 and 5 illustrate a summary of the configuration of an inkjet printer 20 to which the fluid discharge device according to an embodiment of the present invention has been applied. The printer 20 includes a print head (discharge head) 24, and also includes the nozzle inspection device 50 shown in FIG. 5. The print head 24 is capable of discharging ink (a fluid) FL1 from nozzles 23 contained in nozzle rows (nozzle groups) 43. A nozzle inspection part U1 contained in the nozzle inspection device 50 inspects the discharge state of the ink FL1 from the nozzles 23. For example, the nozzle inspection part U1 detects voltage changes (electrical changes) caused by the ink FL1 discharged from the nozzles 23, and contrasts the detected voltage changes and a threshold Vref to determine whether or not the state of the nozzles 23 is normal. A controller U2 contained in the nozzle inspection device 50 performs a pre-process on the nozzles 23 of discharging ink FL2 under a discharge condition that nozzles in an unstable state be put into a dot omission state, and then discharges ink FL3 for inspection and executes an inspection process via the nozzle inspection part U1. This process can be considered a process for purposely putting semi-functional nozzles in an unstable state into a dot omission state to cause them to be determined abnormal, and reliably executing cleaning or another maintenance process, by performing "forced ejection."

When the state of the nozzles 23 is not normal, another cause besides the dot omission state is the unstable state. The dot omission state is a state in which ink droplets are not discharged from the nozzles, that is, a state in which so-called dot omission occurs. The dot omission state includes a clogged state in which ink droplets are not discharged at all from the nozzles. The term "unstable state" means an abnormal state in which although ink droplets are discharged from the nozzles, the traveling direction or discharged quantity of the ink droplets is abnormal. For example, abnormal discharge states include those in which the ink droplets travel not perpendicular to the print surface but skewed, those in which ink droplets are scattered in multiple directions from one nozzle, and those in which the discharged ink quantity is small. Possible causes of unstable states include a mist of discharged ink forming and adhering to the nozzle surfaces, tiny air bubbles getting into the nozzles, and the like.

Figure 1:
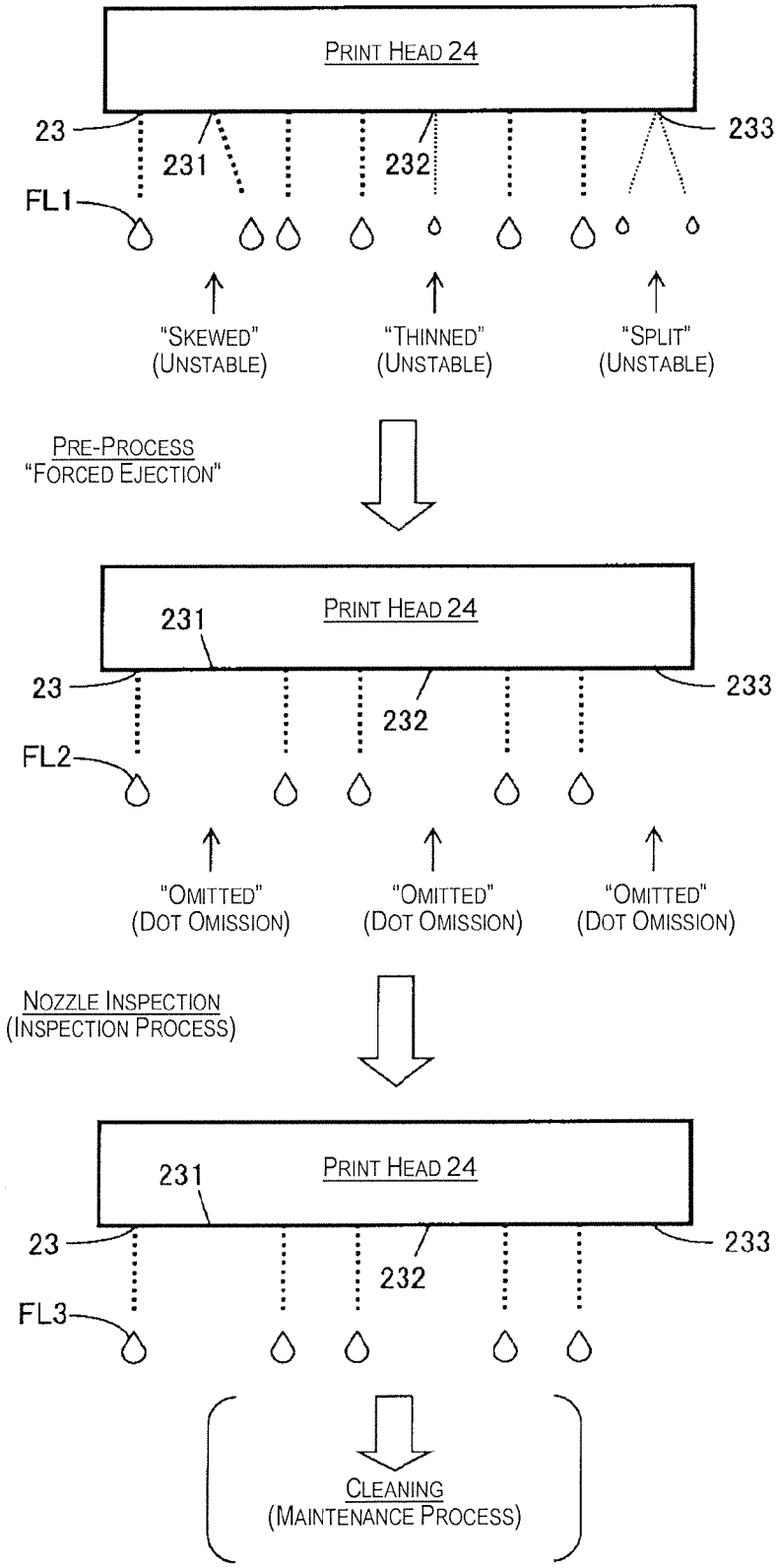
FIG. 1 is a diagram schematically showing an example of a summary of the nozzle inspection method.

The top section of FIG. 1 shows an example of a print head 24 having a nozzle 231 in a "skewed" state (an unstable state), a nozzle 232 in a "thinned" state (an unstable state), and a nozzle 233 in a "split" state (an unstable state). When a nozzle inspection is performed without a pre-process as in a well-known practice, the nozzles 231, 232, 233 in the unstable state are sometimes determined to be in a normal state because they are not in an "omission" state (the dot omission state). In this case, when printing is performed on recording paper, dots of ink droplets discharged from the nozzles 231, 232, 233 in unstable states sometimes reduce the print quality. The present fluid discharge device executes a pre-process of discharging fluid under a discharge condition (a "forced ejection" condition) that nozzles in an unstable state be put into the "omission" state immediately before nozzle inspection, as shown in the middle section of FIG. 1. Preferably, a pre-process is executed for discharging fluid immediately before nozzle inspection under a discharge condition not that nozzles in a normal state be put into the "omission" state, but that nozzles in an unstable state be put into the "omission" state.

The discharge condition that nozzles in an unstable state be put into the "omission" state includes a condition in which drive elements 48 are supplied with a pre-process drive pulse P1 having a drive voltage V1 that is higher than a drive voltage V2 of a recording drive pulse P2 used in the discharge of fluid onto a recording medium M1 (designated as condition 1), a condition in which ink FL2 is discharged at a rate v1 that s higher than the rate of ink discharged onto the recording medium M1 (designated as condition 2), a condition in which the drive elements 48 are supplied with the pre-process drive pulse P1 of a drive frequency f1 that is higher than a drive frequency f2 of the recording drive pulse P2 (designated as condition 3), a combination of some or all of conditions 1, 2, and 3, and the like. The discharge conditions can be varied according to the environment of the print head 24, such as the temperature of the print head 24, the temperature surrounding the print head 24, and the humidity surrounding the print head 24. The flushing time (e.g., the periodic flushing time) during recording in a printing according to a print job is not included in the time of fluid discharge onto the recording medium.

According to the description above, the nozzles 231, 232, 233 in the "skewed" state, the "thinned" state, and the "split" state are in an "omission" state. Consequently, in the nozzle inspection after the pre-process, the nozzles are determined to not be in the normal state, and cleaning or another maintenance process is executed, as shown in the bottom section of FIG. 1.

In the present nozzle inspection method, since nozzles in an unstable state are put in a dot omission state by the pre-process before the inspection process and the inspection process is then performed, the nozzles in an unstable state undergo maintenance after the nozzle inspection. Since fewer nozzles are in the unstable state after the nozzle inspection, the present nozzle inspection method can suppress the nozzles in an unstable state from being used in printing.

(2) Configuration of Printer

The printer 20 shown in FIG. 2 includes a paper feed mechanism 31, a printer mechanism 21, a capping device 40, the nozzle inspection part U1 shown in FIG. 5, a controller 70, an operation panel 79, and other components. The paper feed mechanism 31 conveys the recording medium M1, which is recording paper, in a conveying direction DR2 through the driving of a paper feed roller 35 via a drive motor 33.

The printer mechanism 21 includes a carriage motor 34*a*, a driven roller 34*b*, a carriage belt 32, a carriage 22, an ink cartridge 26, a print head (a discharge head) 24, and other components; and discharges ink droplets from the print head 24 onto the recording medium M1 conveyed onto a platen 38 by the paper feed mechanism 31 to perform printing. The carriage motor 34*a* is disposed on the side opposite the capping device 40 in a mechanical frame 80. The driven roller 34*b* is disposed on the same side as the capping device 40 in the mechanical frame 80. The carriage belt 32 spans between the carriage motor 34*a* and the driven roller 34*b*. The carriage 22 is moved back and forth in a main scan direction DR1 along a guide 28 by the carriage belt 32 along with the driving of the carriage motor 34*a*. The ink cartridge 26 separately accommodates yellow (Y), magenta (M), cyan (C), and black (K) ink containing a dye or pigment as a coloring agent in water (a solvent), and the ink cartridge 26 is mounted on the carriage 22. A linear encoder 36 for detecting the position of the carriage 22 is disposed on the back surface of the carriage 22, and the position of the carriage 22 is managed by this linear encoder 36.

Figure 3:
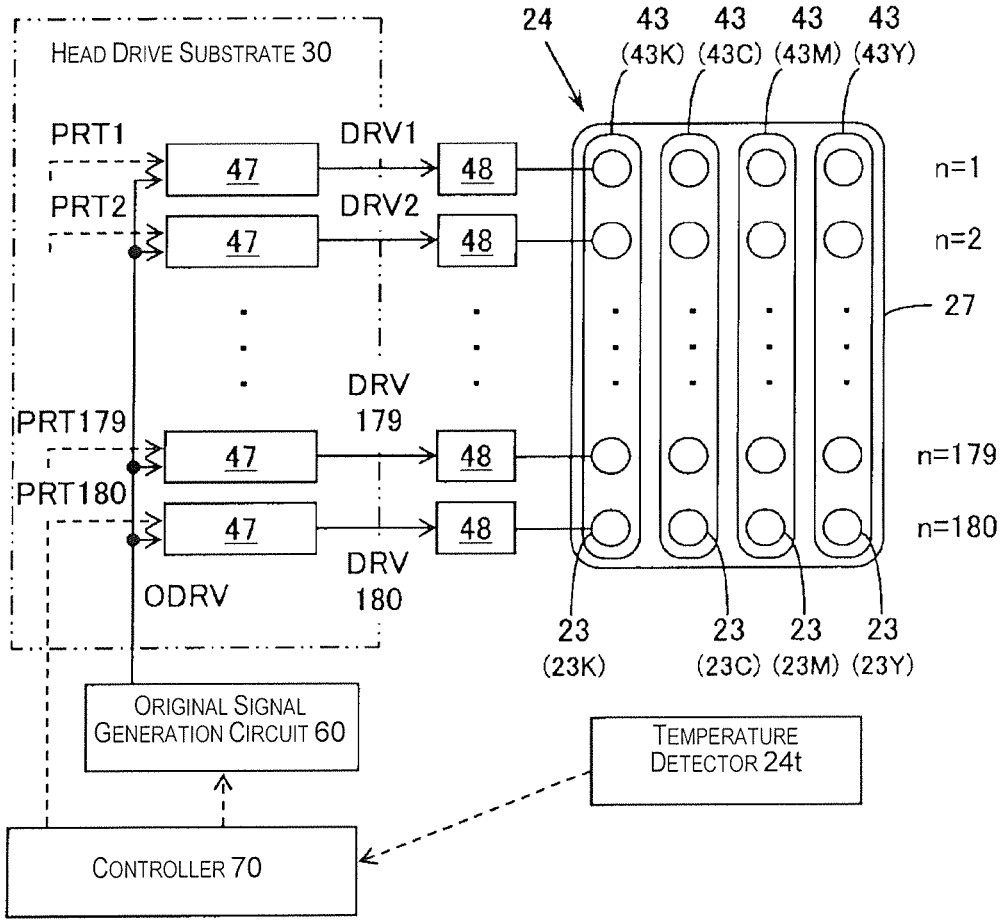
FIG. 3 is a diagram schematically showing the electrical connections of the print head 24.
Figure 4A:
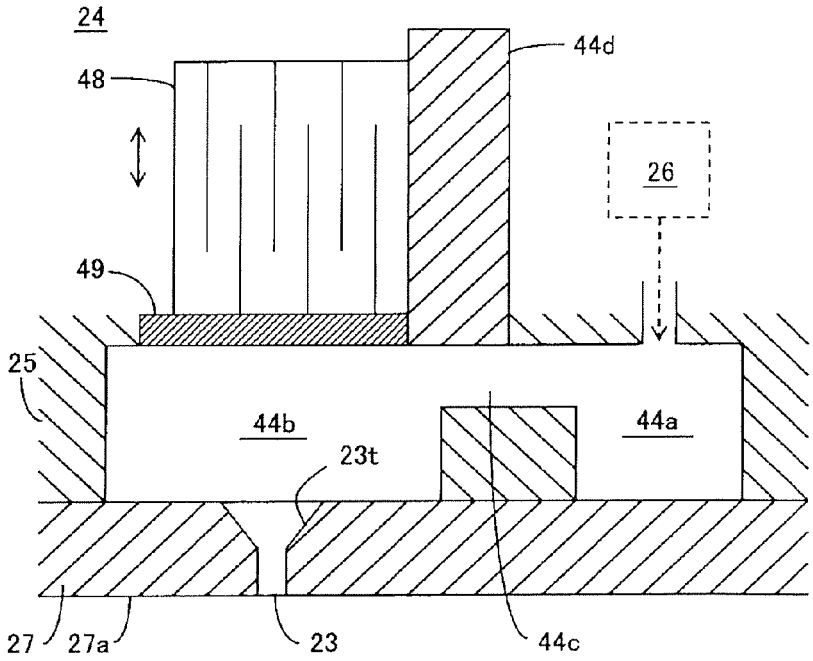
FIG. 4A is a cross-sectional view showing an example of a summary of the configuration of the print head 24, B is a graph showing an example of the pre-process drive pulse P1 supplied to the drive elements 48, and C is a graph showing an example of the recording drive pulse P2 supplied to the drive elements 48.

The print head 24 shown in FIGS. 3 and 4 includes a nozzle plate 27, a cavity plate 25, vibrating panels 49, drive elements 48, drive pulse generation circuits 47, and a temperature detector 24*t*. The nozzle plate 27 is made of stainless steel or the like, in which are formed nozzle rows 43 containing pluralities of nozzles 23 aligned in the conveying direction DR2. The example of FIG. 3 shows a plurality of nozzle rows 43C, 43M, 43Y, 43K disposed in single rows of 180 of each of the nozzles 23C, 23M, 23Y, 23K of the colors C, M, Y, K. The nozzles 23 are tiny through-holes having tapered shapes which decrease gradually in diameter from pressure chambers 44*b* toward a nozzle surface 27*a*. The cavity plate 25, together with the nozzle plate 27 and the vibrating panels 49, forms ink chambers (44*a*, 44*b*) communicated with the nozzles 23. A shared ink chamber 44*a*, which is communicated with pressure chambers 44*b* by ink flow passages 44*c*, functions as an ink buffer area for the pressure chambers 44*b*, and sends ink filled from the ink cartridge 26 to the pressure chambers 44*b*. The drive elements 48 can be piezoelectric elements which are piezo elements, electrostatic drive elements, heaters which heat the ink and use the pressure of air bubbles (bubbles) caused by film boiling to discharge fluid from the nozzles, or the like. The drive element 48 shown in FIG. 4, which is bonded to the side of the vibrating panel 49 opposite the cavity plate 25, causes ink to be discharged from the nozzle 23 in accordance with a supplied drive pulse. The piezoelectric element that can be used as the drive elements 48 is made of a ceramic known as zirconia ceramic, or another material. The drive pulse generation circuits 47 are drive circuits which are formed on a head drive substrate 30 and which output a drive signal to the drive elements 48. According to the controlling of the controller 70, the print head 24 heats the ink and discharge ink droplets by applying a voltage from the drive pulse generation circuits 47 to the drive elements 48 to press down the top walls of the pressure chambers 44*b* with the drive elements 48. The temperature detector 24*t* provided to the print head 24, which is configured from a temperature sensor, for example, detects the environment temperature in which the print head 24 operates and sends a detection signal thereof to the controller 70.

The drive element 48 shown in FIG. 4, which is a stacked piezoelectric vibrating element configured by alternately stacking piezoelectric bodies and internal electrodes, is a piezoelectric vibrating element in a longitudinally vibrating mode of being capable of expanding and contracting in a longitudinal direction (shown by the arrows) orthogonal to the stacking direction, in response to applied voltage. A fixing base material 44*d* for fixing the drive element 48 is configured from a member having sufficient rigidity in order to efficiently transfer vibration of the drive element 48 to the vibrating panel 49. The vibrating panel 49 is a panel-shaped member including a thick part with which the drive element 48 comes in contact, and an elastic thin part in the external periphery, wherein the thick part vibrates in response to the expansion and contraction of the drive element 48.

The drive element can of course also be a piezoelectric element or the like in a transverse vibrating mode in which a shared top electrode, a drive electrode, and a shared bottom electrode are stacked.

The drive pulse generation circuits 47 shown in FIG. 3 input an original signal ODRV and a print signal PRTn generated by an original signal generation circuit 60, and generate and output to the drive elements 48 a drive signal DRVn on the basis of these signals ODRV, PRTn. The final n of the signal PRTn and the signal DRVn is a number for specifying the nozzle included in the nozzle row. The original signal generation circuit 60 outputs a signal that uses a predetermined pulse as a repeating unit to the drive pulse generation circuits 47. The drive pulse generation circuits 47 generate and output to the drive elements 48 a drive signal DRVn on the basis of the original signal ODRV and the separately inputted print signal PRTn. For example, when a drive signal DRVn of a pulse format having a comparatively small electric potential difference is outputted to the drive elements 48, one shot of ink droplets is discharged from the nozzles 23 to form small dots on the recording medium M1; when a drive signal DRVn of a pulse format having a medium-sized electric potential difference is outputted to the drive elements 48, one shot of ink droplets is discharged from the nozzles 23 to form medium-sized dots on the recording medium M1; and when a drive signal DRVn of a pulse format having a comparatively large electric potential difference is outputted to the drive elements 48, one shot of ink droplets is discharged from the nozzles 23 to form large dots on the recording medium M1.

The capping device 40 shown in FIG. 5 includes a cap 41, a suction pump 45, an air relief valve 46, and a raising/lowering device 90; and the capping device 40 is provided to a position facing a home position at one end of the platen 38. The cap 41 has a substantially rectangular parallelepiped or other shape, the top part of which is open. The suction pump 45 is attached to a flexible tube 45*a* connected to a floor part of the cap 41. The air relief valve 46 is attached to a flexible tube 46*a* connected to a floor part of the cap 41. The raising/lowering device 90 raises and lowers the cap 41 in order to bring together and separate the top surface of the cap 41 and the surface of the nozzle plate 27. To suppress thickening (drying) of the ink in the nozzles 23, the capping device 40 raises the cap 41 to seal the nozzle plate 27, with the print head 24 having been moved to the home position facing the capping device 40 during a pause in printing. By closing the air relief valve 46 with the nozzle plate 27 sealed at a predetermined timing and driving the suction pump 45, the capping device 40 creates negative pressure in an internal space formed by the print head 24 and the cap 41 and forcefully draws ink into the nozzles 23. This process is referred to as cleaning.

The nozzle inspection part U1 shown in FIG. 5 includes an electrode 52, a voltage application circuit 54, a voltage detection circuit 56, a comparison circuit 57, and other components.

The electrode 52 is disposed in the cap 41. The electrode 52 can be made of stainless steel or the like in the form of a mesh. An ink-absorbing body (e.g., an electroconductive sponge) on which ink droplets land can be provided on the top side of the electrode 52. An ink-absorbing body (e.g., a non-woven cloth known as felt) for absorbing ink that has permeated downward can be provided on the bottom side of the electrode 52. The nozzle inspection part U1 determines whether or not ink droplets (FL1) have been discharged as normal from the nozzles 23, by detecting a voltage change ΔV1 that occurs in the electrode 52 when ink droplets (FL1) land on the cap 41 due to electrically charged ink droplets (FL1) being discharged from the nozzles 23 into the cap 41.

The voltage application circuit 54 has a high-voltage power source Ve in which the voltage of an electrical wire of several volts lead through the printer 20 is boosted by a booster circuit to a DC voltage of several hundred volts or one thousand several hundred volts, and the high-voltage power source Ve is connected to the electrode 52 via a resistance circuit R1 (e.g., a 1 MΩ resistance element) and a switch SW1, sequentially. When the switch SW1 is turned on, the electrode 52 and the high-voltage power source Ve can be connected, and when the switch SW1 is turned off, the high-voltage power source Ve can be separated from the electrode 52 and connected to ground. The nozzle plate 27 of the print head 24, together with the mechanical frame 80, is connected to ground. Consequently, when the switch SW1 is on, an electric potential difference arises between the nozzle plate 27 and the electrode 52.

The voltage detection circuit 56, which is connected to the electrode 52, is a circuit for detecting voltage changes that occur in the electrode 52. Detected voltage changes can be assumed to be the difference between the maximum voltage and minimum voltage of the voltage signal inputted to the voltage detection circuit 56, for example. The voltage detection circuit 56 can convert the inputted analog voltage to a digital value by an A/D converter (analog-digital converter). To increase voltage changes that occur in the electrode 52 when electrically charged ink droplets land on the cap 41, the peak value of the voltage waveform occurring in the electrode 52 can be extracted and held, the held peak value can be added, and the added voltage signal can be amplified. Such an amplified signal is also included in the voltage change (electrical change) ΔV1 of the present technique.

In the comparison circuit 57, threshold Vref for contrasting with the voltage change ΔV1 detected by the voltage detection circuit 56 is inputted from the controller 70 and retained. The voltage change ΔV1 and the threshold Vref are contrasted, when the voltage change ΔV1 is higher than the threshold Vref (to the higher side from the threshold Vref), a determination signal (the contrast result) Vout having a voltage of a high level H is outputted to the controller 70, and when the voltage change ΔV1 is lower than the threshold Vref (to the lower side from the threshold Vref), a determination signal (the contrast result) Vout having a voltage of a low level L is outputted to the controller 70. The voltage change ΔV1 being higher than the threshold Vref includes both the voltage change ΔV1 being equal to or greater than the threshold Vref, and the voltage change ΔV1 being greater than the threshold Vref. The voltage change ΔV1 being lower than the threshold Vref includes both the voltage change ΔV1 being equal to or less than the threshold Vref, and the voltage change ΔV1 being less than the threshold Vref. The threshold need only be the object of contrast with the detected electrical change specified as a voltage change, and the threshold includes various possible aspects: a digital value threshold in cases in which the detected electrical change is expressed by a digital value, a gradation value threshold in cases in which the detected electrical change is expressed by a gradation value, an analog threshold in cases in which the detected electrical change is expressed in analog form specified as a voltage state, etc.

The comparison circuit 57 can store the threshold Vref in a threshold register, compare the digital value of the voltage change ΔV1 and the threshold Vref of the threshold register by a voltage comparison part, store the comparison result (the contrast result) in a comparison result register, and output the comparison result of the comparison result register as a determination signal Vout to the controller 70. This comparison result is preferably a "1" which expresses H when the digital value of the voltage change is higher than the threshold Vref, or a "0" which expresses L when the digital value of the voltage change is lower than the threshold Vref.

When ink droplets are not discharged from the nozzles 23 or when there are fewer ink droplets than usual, the voltage change ΔV1 occurring in the electrode 52 is less than when ink droplets are discharged normally. In view of this, setting a threshold Vref which distinguishes between these cases makes it possible to determine whether or not the state of the nozzles 23 is normal.

The controller 70 shown in FIGS. 2 and 5 includes a central processing unit (CPU) 72, a read-only memory (ROM) 73, a random-access memory (RAM) 74, a nonvolatile memory 75, an interface (I/F) 76, an input/output port, and other components; and the controller 70 controls the entire printer 20. The ROM 73 stores various processing programs including the nozzle inspection program. The nozzle inspection program makes the controller 70, which is a computer, function as the controller U2. The nozzle inspection program can be recorded on an external recording medium that can be read by a computer. The RAM 74 is provided with a print buffer area, and print data sent from the casing 10 via the I/F 76 is temporarily stored in the print buffer area. Flash memory or the like can be used as the nonvolatile memory 75. The I/F 76 inputs print jobs from a host device 10, and outputs print status information and the like to the host device 10. The determination signal Vout from the comparison circuit 57, a position signal of the carriage 22 from the linear encoder 36, and other signals are inputted to the input port. From the output port, the controller 70 outputs a control signal to the print head 24 including the drive pulse generation circuits 47 and the drive elements 48, a switch signal to the switch SW1, a control signal to the original signal generation circuit 60, a drive signal to the drive motor 33, a drive signal to the carriage motor 34*a*, a drive signal to the raising/lowering device 90, the threshold Vref, and other information. The controller 70, together with the original signal generation circuit 60, constitutes the controller U2.

Possible examples of the host device 10 include a personal computer or another computer, a digital camera, a digital video camera, a portable phone, and the like.

(3) Description of Pre-Process

Figure 4B:
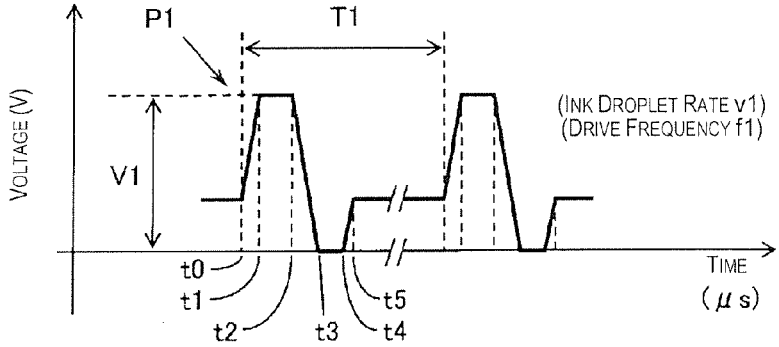
Figure 4C:
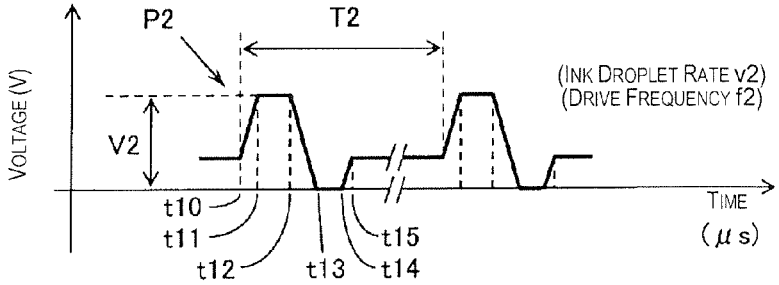

FIG. 4B shows an example of the pre-process drive pulse P1 supplied to the drive elements 48 during the pre-process. FIG. 4C shows an example of the recording drive pulse P2 supplied to the drive elements 48 when usual printing is performed. In FIGS. 4B and C, the horizontal axis represents time, and the vertical axis represents voltage.

The pre-process drive pulse P1 shown in FIG. 4B has a rising pulse portion (time t0 to t1), a peak portion (time t1 to t2), a falling pulse portion (time t2 to t3), a trough portion (time t3 to t4), and a reverting portion (time t4 to t5). In the rising pulse portion (time t0 to t1), the voltage value of the drive elements 48 increases at a constant rate from a steady state to a peak voltage value (V1). V1 is a type of drive voltage of the pre-process drive pulse P1, and is the electric potential difference between the maximum electric potential and the minimum electric potential (e.g., a voltage value of 0) in the pre-process drive pulse P1. The peak portion (time t1 to t2) is a portion where the voltage value of the drive elements 48 is retained constantly at the peak voltage value (V1), and is the time period in which ink droplets are discharged. In the falling pulse portion (time t2 to t3), the voltage value of the drive elements 48 falls at a constant rate from the peak voltage value (V1) to the minimum electric potential. In the trough portion (time t3 to t4), the voltage value of the drive elements 48 is retained constantly at the minimum electric potential. In the reverting portion (time t4 to t5), the voltage value of the drive elements 48 increases at a constant rate from the minimum electric potential and returns to a steady state. Since ink droplets are repeatedly discharged a predetermined number of times from the nozzles 23, the pre-process drive pulse P1 is repeatedly supplied a predetermined number of times to the drive elements 48. During pre-process, ink droplets are simultaneously discharged in units of nozzle rows 43 from all of the nozzles 23 included in the nozzle rows 43.

The recording drive pulse P2 shown in FIG. 4C has a rising pulse portion (time t10 to t11), a peak portion (time t11 to t12), a falling pulse portion (time t12 to t13), a trough portion (time t13 to t14), and a reverting portion (time t14 to t15). Since ink droplets are repeatedly discharged a predetermined number of times from the nozzles 23, the recording drive pulse P2 is repeatedly supplied a predetermined number of times to the drive elements 48. During printing, the nozzles 23 from which ink droplets are discharged change according to the print data.

The nozzles 23 are prevented from going into a dot omission state even when in an unstable state during printing, and nozzles 23 in an unstable state are put into a dot omission state during the pre-process; therefore, the pre-process drive pulse P1 and the recording drive pulse P2 have different waveforms.

The drive voltage of the drive pulse of recording flushing performed during printing or of pre-printing flushing performed immediately before printing is the same as the drive voltage V2 of the recording drive pulse P2, for example. The drive pulse of recording flushing or pre-printing flushing is also sometimes the same as the recording drive pulse P2. Since ink droplets are repeatedly discharged a predetermined number of times from the nozzles 23, a drive pulse for usual flushing is repeatedly supplied a predetermined number of times to the drive elements 48. During usual flushing, ink droplets are simultaneously discharged in units of nozzle rows 43 from all of the nozzles 23 included in the nozzle rows 43, for example.

A drive pulse of air bubble removal flushing, intended to remove air bubbles mixed in the nozzles 23 and the pressure chambers 44*b*, has a waveform such that the rate of discharged ink droplets is slower than the ink droplet rate caused by the recording drive pulse P2, and the drive frequency is lower than the drive frequency f2 of the recording drive pulse P2. Since ink droplets are repeatedly discharged a predetermined number of times from the nozzles 23, a drive pulse for air bubble removal flushing is repeatedly supplied a predetermined number of times to the drive elements 48. During air bubble removal flushing, ink droplets are simultaneously discharged in units of nozzle rows 43 from all of the nozzles 23 included in the nozzle rows 43, for example.

The pre-process drive pulse P1 can have various possible aspects, as long as it is a drive pulse which causes the ink FL2 to be discharged from the nozzles 23 under a discharge condition that nozzles in an unstable state be put into a dot omission state. For example, the drive voltage V1 of the pre-process drive pulse P1 is increased above the drive voltage V2 of the recording drive pulse P2. The pre-process drive pulse P1 can be a drive pulse which causes ink droplets to be discharged from the nozzles 23 at a rate v1 higher than the rate v2 of ink droplets discharged from the nozzles 23 by the recording drive pulse P2. Furthermore, the drive frequency f1 of the recording drive pulse P1 can be increased above the drive frequency f2 of the recording drive pulse P2. Specifically, the cycle T1 of the pre-process drive pulse P1 can be shorter than the cycle T2 of the recording drive pulse P2.

Figure 6A:
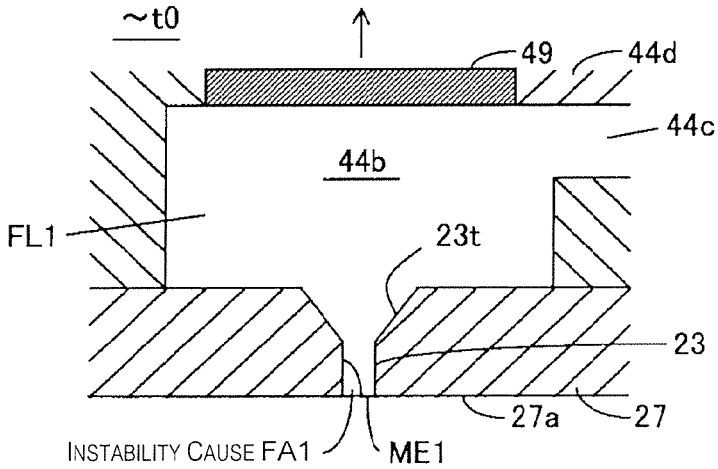
FIGS. 6A through C are diagrams schematically showing an example of a mechanism whereby a nozzle 23 in an unstable state assumes a dot omission state due to the pre-process.
Figure 6B:
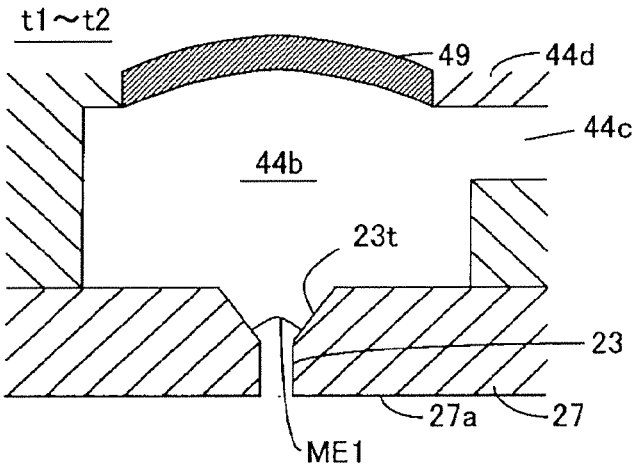
Figure 6C:
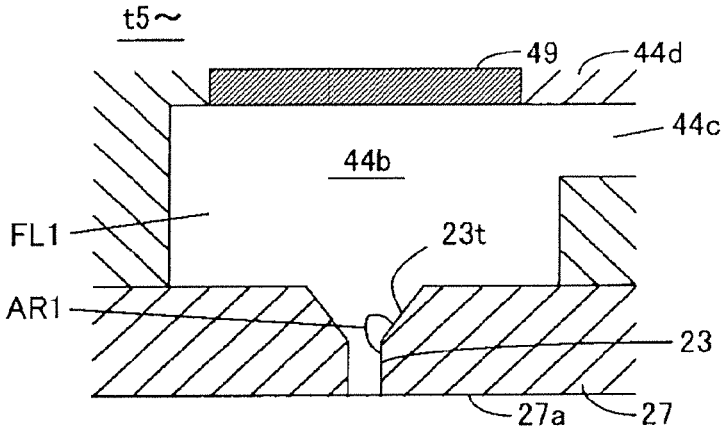

FIGS. 6A to C schematically show an example of the mechanism whereby nozzles in an unstable state are set in a dot omission state by the pre-process. FIG. 6A shows an example of the state of a pressure chamber 44*b* before the pre-process is performed (leading up to time t0 in FIG. 4B) in a case in which a nozzle 23 is in an unstable state. Ink FL1 is filled into this pressure chamber 44*b*, and an instability cause FA1 is present in the nozzle 23. Possible examples of the instability cause FA1 include adhesion of mist of the discharged ink, entrainment of air bubbles, ink thickening, and the like. FIG. 6B shows an example of the state of the pressure chamber 44*b* during time t1 to t2 in FIG. 4B. The drive element 48 contracts as the applied voltage increases when a rising pulse portion Pwc is supplied. The vibrating panel 49 then bends toward the outer side of the pressure chamber 44*b* (upward in FIG. 6B), and negative pressure occurs in the ink FL1 in the pressure chamber 44*b*. In the meniscus ME1 present in the nozzle 23 at this time, the extent of bending increases in the same direction as the vibrating panel 49. When an instability cause FA1 is present in the nozzle 23, the meniscus ME1 is drawn in up to a tapered portion 23*t* deep inside the nozzle 23 by the strong suction caused by the pre-process drive pulse P1. FIG. 6C shows an example of the state of the pressure chamber 44*b* at or beyond time t5. Due to the meniscus ME1 entering the tapered portion 23*t* during printing despite not normally entering, an air bubble AR1 gets into the nozzle 23 even if the voltage value applied to the drive element 48 returns to a steady state. Thereby, even if a drive pulse is supplied to the drive element 48 in an attempt to cause an ink droplet to be discharged from the nozzle 23, it is estimated that a dot omission state has occurred in which an ink droplet is not discharged due to the presence of the air bubble AR1, which has the property of absorbing the pressure change.

When the nozzle 23 is in a normal state, there is no instability cause FA1 in the nozzle, and the meniscus ME1 is therefore not readily drawn into the tapered portion 23*t* even by strong suction caused by the pre-process drive pulse P1. Consequently, a nozzle in a normal state does not go into a dot omission state, and a nozzle in an unstable state does go into a dot omission state.

For example, if an unusual drive voltage is supplied to the drive element 48, the nozzle in a normal state will sometimes go into a dot omission state. The voltages have the relationship 0<V2<Vuc<Vmax, wherein Vmax is a drive voltage set for a nozzle in a normal state going into a dot omission state, and Vuc is a drive voltage set for a nozzle in an unstable state going into a dot omission state (V2 is the drive voltage of the recording drive pulse P2). The drive voltage V1 of the pre-process drive pulse P1 is preferably set so that Vuc≤V1<Vmax. The drive voltages Vmax, Vuc are preferably decided through experimenting according to the type of the printer 20. For example, in a case in which the result of the experiment is that the drive voltage Vmax for a nozzle in a normal state going into a dot omission state is a 15% increase of the drive voltage V2 during printing, and the drive voltage Vuc for a nozzle in an unstable state going into a dot omission state is a 10% increase of the drive voltage V2 during printing; the drive voltage V1 during the pre-process is preferably a 13% increase of the drive voltage V2 during printing, or some other increase of at least 10% and less than 15%.

The drive voltage V1 during the pre-process can be changed according to the environment of the print head 24, such as the temperature of the print head 24, the temperature surrounding the print head 24, and the humidity surrounding the print head 24. For example, since the drive voltage that causes a dot omission state decreases as the temperature of the print head 24 increases depending on the properties of the ink, the drive voltage V1 can be lowered as the temperature detected by the temperature detector 24*t* increases.

If a drive pulse that causes ink droplets to be discharged is supplied to the drive element 48 at an unusual rate, a nozzle in a normal state will sometimes go into a dot omission state. The ink droplet rates have the relationship 0<v2<vuc<vmax, wherein vmax is an ink droplet rate set for a nozzle in a normal state going into a dot omission state, and vuc is an ink droplet rate set for a nozzle in an unstable state going into a dot omission state (v2 is the ink droplet rate of the recording drive pulse P2). The ink droplet rate v1 of the pre-process drive pulse P1 is preferably set so that vuc≤v1≤vmax. The ink droplet rates vmax, vuc are preferably decided through experimenting according to the type of the printer 20.

The ink droplet rate v1 during the pre-process can be changed according to the environment of the print head 24, such as the temperature of the print head 24, the temperature surrounding the print head 24, and the humidity surrounding the print head 24. For example, since the ink droplet rate that causes a dot omission state slows as the temperature of the print head 24 increases, the ink droplet rate v1 can be slowed as the temperature detected by the temperature detector 24*t* increases.

Furthermore, if a drive pulse of an unusual drive frequency is supplied to the drive element 48, a nozzle in a normal state will sometimes go into a dot omission state. The drive frequencies have the relationship 0<f2<fuc<fmax, wherein fmax is a drive frequency set for a nozzle in a normal state going into a dot omission state, and fuc is a drive frequency set for a nozzle in an unstable state going into a dot omission state (f2 is the drive frequency of the recording drive pulse P2). The drive frequency f1 of the pre-process drive pulse P1 is preferably set so that fuc≤f1<fmax. The drive frequencies fmax, fux vuc are preferably decided through experimenting according to the type of the printer 20.

The drive frequency f1 during the pre-process can be changed according to the environment of the print head 24, such as the temperature of the print head 24, the temperature surrounding the print head 24, and the humidity surrounding the print head 24. For example, since the drive frequency that causes a dot omission state decreases as the temperature of the print head 24 increases, the drive frequency f1 can be lowered as the temperature detected by the temperature detector 24*t* increases.

(4) Description of Nozzle Inspection Process

Next, an example of the nozzle inspection process performed by the controller 70 is described with reference to FIG. 7. This process is executed when a nozzle inspection is commanded, for example. Examples of a command for a nozzle inspection include a predetermined operation input for issuing a nozzle inspection command to the printer 20 from the user, a predetermined signal input for issuing a nozzle inspection command to the printer 20 from the host device 10, and the like. The nozzle inspection process can be executed at times such as when the power source is turned on, a print job is received from the host device 10, a printing of one page on the recording medium M1 has ended, a printing of a predetermined number of pages on the recording medium M1 has ended, and the carriage has ended a predetermined number of main scan passes.

When the nozzle inspection process begins, the controller 70 drives the carriage motor 34*a* and moves the carriage 22 to the home position (step S102, hereinbelow the word "step" is abbreviated). The nozzle plate 27 of the print head 24 and the capping device 40 thereby come to face each other. At this time, a predetermined gap GA1 (see FIG. 5) is formed between the nozzles 23 and the electrode 52. In S104, the switch SW1 is switched to on to turn on the voltage application circuit 54, and a voltage of the high-voltage power source Ve is applied to the electrode 52. In S106, a counter C that indicates the number of times the maintenance process has been executed is provided to the RAM 74, and 1 is substituted in this counter C. In S108, a nozzle determination process associated with the pre-process described hereinafter is performed, and the determination result is kept in the RAM 74 or other memory.

In S110, a judgment is made as to whether or not dot omission has been detected, i.e., whether or not the state of the nozzles, preferably all of the nozzles, is normal. For example, a judgment is preferably made as to whether or not the determination result kept in the RAM 74 or other memory is information indicating a normal state. When dot omission is not detected, the controller 70 switches the switch SW1 to off to turn off the voltage application circuit 54 and disconnect the circuit from the electrode 52 (S120), and the nozzle inspection process is ended.

When dot omission has been detected, the controller 70 judges whether or not the counter C exceeds a counter threshold Cref (S112). The counter threshold Cref is set as an upper limit of the number of times the maintenance process is repeated, such as two times, for example. When C≤Cref, the controller 70 performs the maintenance process specified as a cleaning process, for example (S114). In the cleaning process, negative pressure is created in the internal space formed by the print head 24 and the cap 41 with the nozzle plate 27 in a sealed state, and the ink in the nozzles 23 is forcefully suctioned out. The ink built up in the nozzles 23 is thereby removed by suction. During the maintenance process, wiping or another maintenance process that does not include a suction action can be performed. Wiping is a process of scraping the nozzle surface 27*a* with a wiper provided to the side of the cap 41, for example. After the maintenance process, the controller 70 adds 1 to the counter C (S116) and returns the process to S108.

When C>Cref in S112, the state of the nozzles 23 is not normal despite the maintenance process having been repeated, and the controller 70 therefore causes a display part of the operation panel 79 to perform an error display to the effect that the abnormal state of the nozzles is irresolvable (S118). The controller 70 then turns the voltage application circuit 54 off (S120) and ends the nozzle inspection process.

Figure 7:
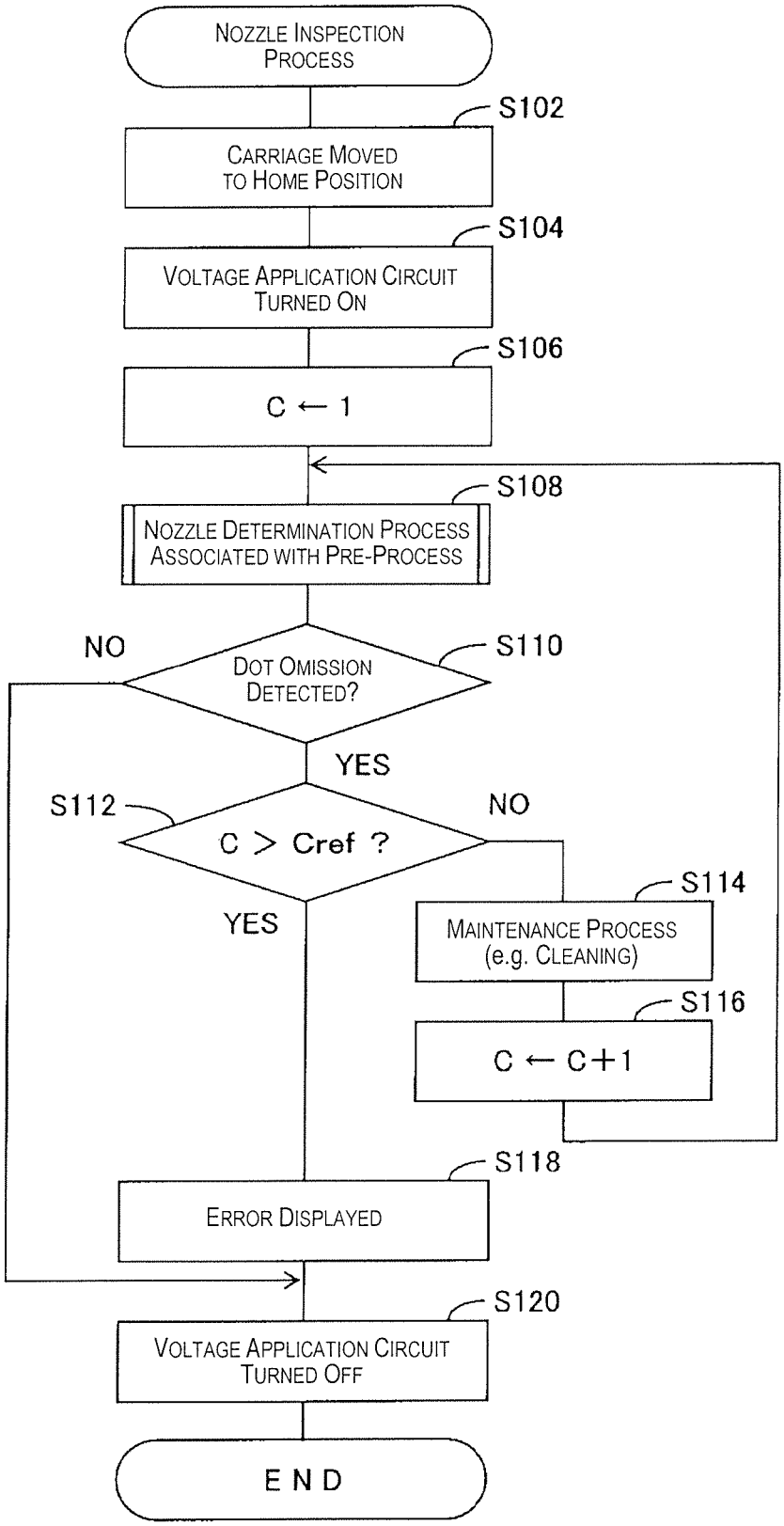
FIG. 7 is a flowchart showing an example of the nozzle inspection process.
Figure 8:
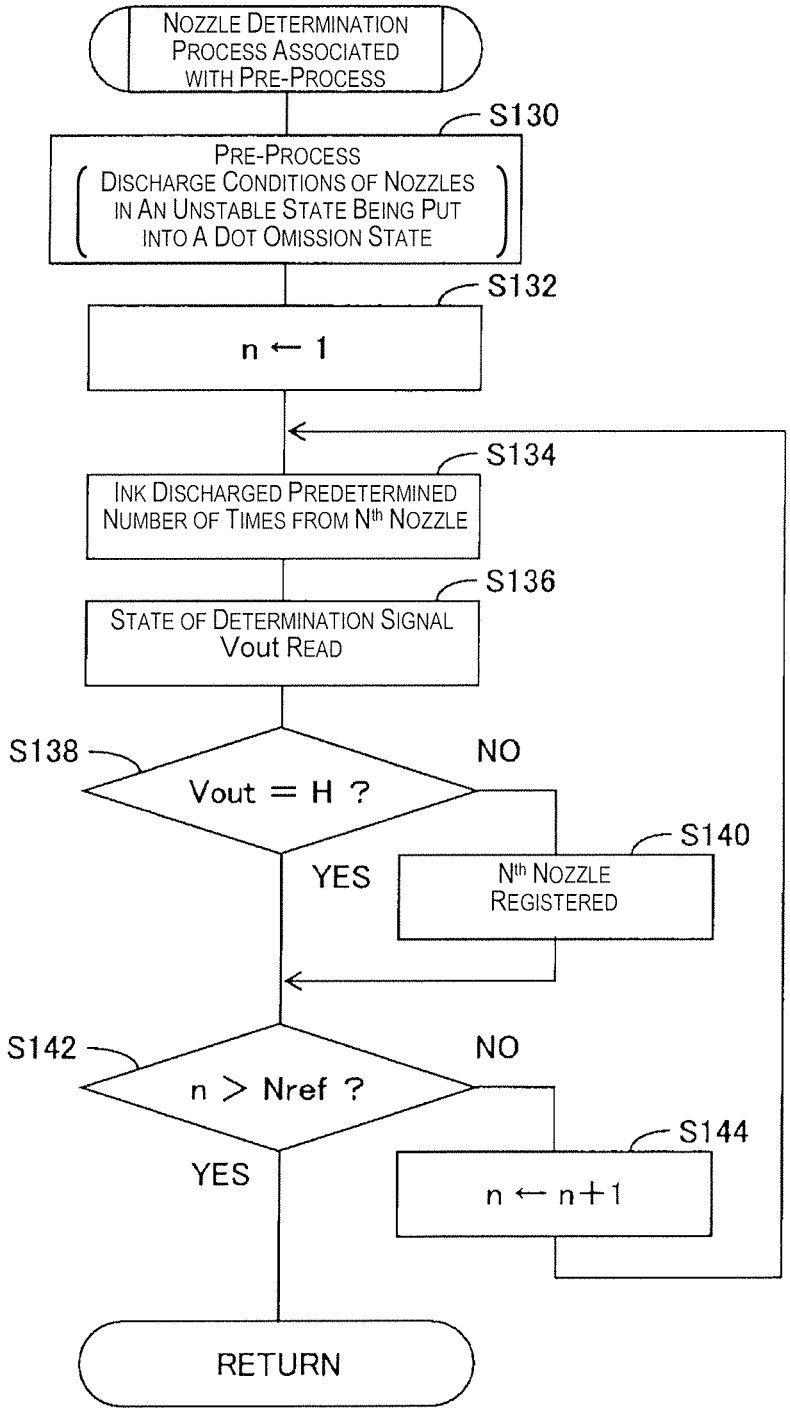
FIG. 8 is a flowchart showing an example of the nozzle determination process associated with the pre-process.

(5) Nozzle Determination Process of Executing Pre-Process for Increasing Drive Voltage FIG. 8 uses a flowchart to show an example of the nozzle determination process associated with the pre-process performed in S108 of FIG. 7. This process is performed on all of the nozzles 23 provided to the print head 24, but for the sake of simplification, the description focuses on the 180 nozzles (23K) of any one (e.g., the nozzle row 43K) of the nozzle rows 43C, 43M, 43Y, 43K. When the nozzle determination process is performed separately for each of the nozzle rows 43, the process of FIG. 8 can be performed for each of the respective nozzle rows 43C, 43M, 43Y, 43K. Higher than the threshold is stated herein as "equal to or greater than," and lower than the threshold is stated as "equal to or less than." Consequently, the statement "equal to or greater than" includes the meaning of "greater than," and the statement "equal to or less than" includes the meaning of "less than." These premises apply in the following description unless stated otherwise.

When the nozzle determination process associated with the pre-process begins, the controller 70 performs control on the print head 24 for repeatedly supplying to the drive elements 48 the pre-process drive pulse P1 having a drive voltage V1 higher than the drive voltage V2 of the recording drive pulse P2, and executes the pre-process of discharging ink FL2 from all of the nozzles 23 under the discharge condition that nozzles in a normal state not be put into a dot omission state and nozzles in an unstable state be put into a dot omission state (S130). The drive voltage V1 can be lowered as the temperature detected by the temperature detector 24*t* increases. Due to the pre-process being executed, nozzles in an unstable state such as the nozzles 231, 232, 233 shown in the top section of FIG. 1 go into a dot omission state as shown in the middle section of FIG. 1.

After the pre-process, the controller 70 executes the inspection process using the nozzle inspection part U1. First, the controller 70 provides the RAM 74 with a counter n indicating the number of times the determination target nozzles have been set, and substitutes 1 for this counter n (S132). In S134, the print head 24 is controlled so that a predetermined number of shots of ink FL3 are discharged from the $n^{th}$ nozzle. Specifically, ink droplet discharge during the nozzle determination process is performed for each nozzle one by one. The predetermined number of shots is preferably set to 8 to 24 shots or another number according to the type of printer or other factors. At this time, the voltage detection circuit 56 detects the voltage change ΔV1 occurring due to the ink droplet discharge from the $n^{th}$ nozzle. The comparison circuit 57 contrasts the voltage change ΔV1 and the threshold Vref, generates a determination signal Vout of H and outputs the signal to the controller 70 when ΔV1 is higher than Vref, and generates a determination signal Vout of L and outputs the signal to the controller 70 when ΔV1 is lower than Vref.

The controller 70 reads the state of the determination signal Vout inputted to the input port (S136), and branches the process according to the state of the determination signal Vout (S138). If the state of the determination signal Vout is L (ΔV1 is equal to or less than Vref), the controller 70 registers the $n^{th}$ nozzle as a nozzle not in a normal state in the RAM 74 or other memory (S140). In S142, a judgment is made as to whether or not the counter n has exceeded a counter threshold Nref. The counter threshold Nref is set as the number of nozzles whose states are determined, and is established at 180 in the case that the states of all 180 nozzles will be determined. When n≤Nref, the controller 70 adds 1 to the counter n (S144) and returns the process to S134. When n>Nref, the controller 70 ends the nozzle determination process associated with the pre-process.

As described above, a determination is made for each nozzle as to whether or not the nozzle is in a normal state.

Herein, nozzles in an unstable state such as the nozzles 231, 232, 233 in the top section of FIG. 1 are put into a dot omission state as shown in the middle section of FIG. 1 by the pre-process of S130 before the inspection process, and the nozzle determination process (the inspection process) is performed in this state; therefore, nozzles in an unstable state undergo maintenance after the nozzle inspection.

The above-described nozzle inspection process can be applied in various situations, such as the initial replenishing of ink from an ink cartridge, at intervals of predetermined time period during non-printing, the receiving of operation input of a manual cleaning process, and the continuing of the printing process.

Another mode of the present technique is that after the pre-process is performed on the nozzles for discharging fluid under the discharge condition that nozzles in a normal state not be put into a dot omission state but nozzles in an unstable state be put into a dot omission state, fluid is discharged for the inspection and the inspection process is executed using the nozzle inspection part U1. Other modes of the present technique include the pre-process being performed immediately before the inspection process right from the start, the pre-process being executed before the inspection process without exception, the pre-process being executed as part of the nozzle inspection process, the nozzle inspection process involving the pre-process and the inspection process being executed as a series of actions, the pre-process being executed before a predetermined time duration in which the inspection process is executed, etc.

As described above, in the present aspect, since fewer nozzles are in an unstable state after the nozzle inspection, it is possible to suppress nozzles in an unstable state from being used in printing. Therefore, the number of nozzles in an unstable state used in printing can be reduced without performing maintenance after nozzle inspection, and the loss of print quality can be suppressed.

Figure 9A:
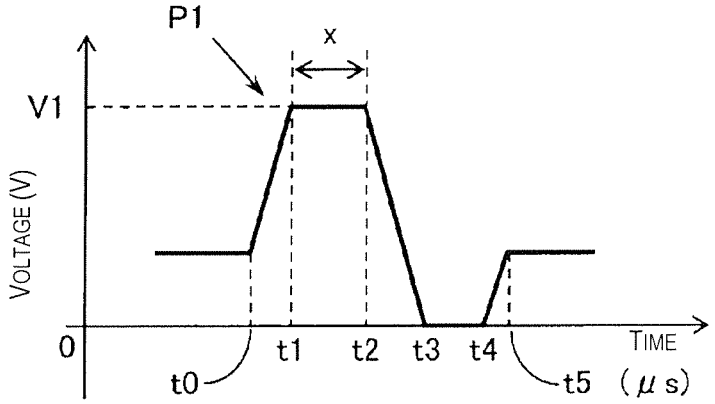
FIG. 9A is a graph showing an example of the pre-process drive pulse P1, and B is a graph showing an example of the relationship between the peak time x and the rate Vm of ink droplets.
Figure 9B:
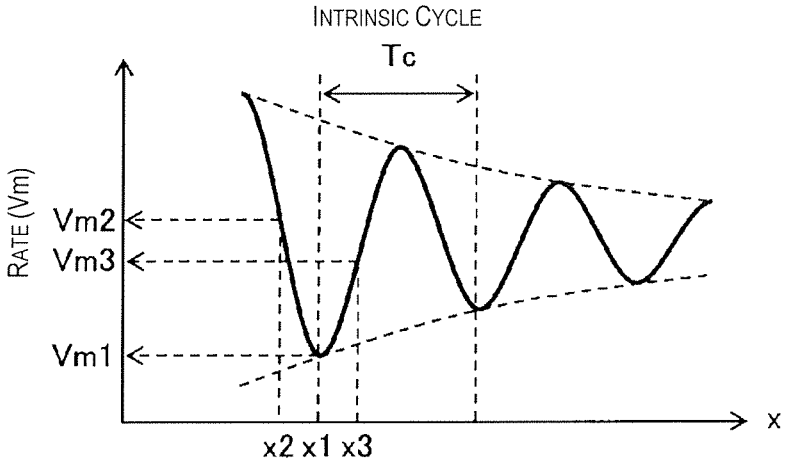

(6) Nozzle Determination Process in which Pre-Process for Raising Ink Droplet Rate is Executed FIGS. 9A and B schematically show an example of the principle of changing the rate Vm of ink droplets discharged from the nozzles 23. In FIG. 9A, the horizontal axis represents time, and the vertical axis represents voltage. The time t2-t1 of the peak portion of the pre-process drive pulse P1 is indicated by the peak time x, as shown in FIG. 9A. In FIG. 9B, the horizontal axis represents the peak time x, and the vertical axis represents the ink droplet rate Vm. The ink droplet rate Vm relative to the peak time x shows the characteristics of a vibration curve shape which attenuates in intrinsic cycles Tc of the print head determined by the shape of the nozzles 23. For example, assuming the ink droplet rate is Vm1 at the time x=x1 where the amplitude of the vibration curve reaches a minimum, the ink droplet rates Vm2, Vm3 at the times x2, x3 (x2<x1<x3) within a range of Tc/2 will be such that Vm2>Vm1 and Vm3>Vm1. The ink droplet rate Vm can be changed by taking such characteristics into account.

The nozzle determination process in a case that the pre-process is performed to raise the ink droplet rate can be executed according to the flowchart shown in FIG. 8. In S130, the controller 70 preferably performs control on the print head 24 which causes the pre-process drive pulse P1 of the peak time x, at which the ink droplet rate v1 is higher than the ink droplet rate v2 of the recording drive pulse P2, to be repeatedly supplied to the drive elements 48, and executes the pre-process for discharging ink FL2 from all of the nozzles 23. The ink droplet rate v1 can be slowed as the temperature detected by the temperature detector 24*t* increases. Nozzles in an unstable state go into the dot omission state due to the pre-process being executed. After the pre-process, the controller 70 preferably executes the inspection process using the nozzle inspection part U1.

According to the pre-process for discharging ink FL2 with a raised ink droplet rate, since the nozzle determination process (the inspection process) is performed after the nozzles in an unstable state have gone into a dot omission state, the nozzles in an unstable state undergo maintenance after the nozzle inspection. Since fewer nozzles are in an unstable state after the nozzle inspection, the present aspect also can suppress nozzles in an unstable state from being used in printing.

The pre-process drive pulse P1 supplied to the drive elements 48 in S130 can have a peak time x with an ink droplet rate v1 higher than the ink droplet rate v2 of the recording drive pulse P2, and can also have a drive voltage V1 higher than the drive voltage V2 of the recording drive pulse P2.

Figure 10A:
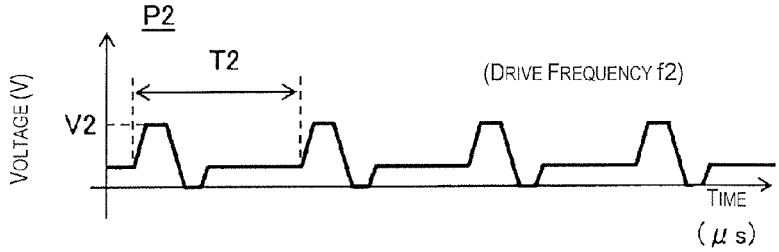
FIG. 10A is a graph showing an example of the recording drive pulse P2, B and C are graph showing examples of the pre-process drive pulse P1 with the drive frequency increased, and D is a graph showing an example of the change over time in the position of the meniscus ME1.
Figure 10B:
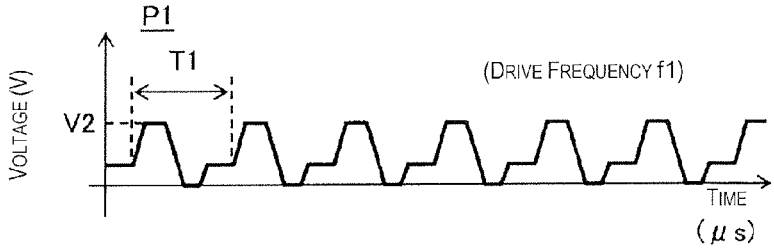
Figure 10C:
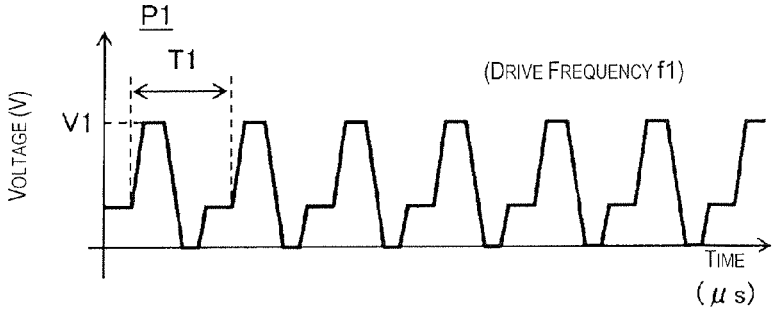
Figure 10D:
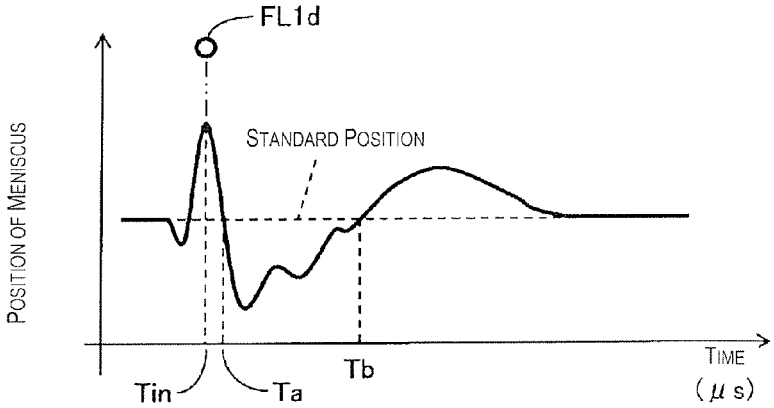

(7) Nozzle Determination Process of Executing Pre-Process for Increasing Drive Frequency FIG. 10A shows an example of the recording drive pulse P2 with a drive frequency 12. FIGS. 10B and C illustrate examples of the recording drive pulse P1 with a drive frequency f1 higher than the drive frequency f2. In FIGS. 10A through C, the horizontal axis represents time, and the vertical axis represents voltage. FIG. 10D is a graph showing an example of the change over time in the position of the meniscus ME1 and is a graph for describing how nozzles in an unstable state go into a dot omission state due to the drive frequency being increased. In FIG. 10D, the horizontal axis represents time, the vertical axis represents the position of the meniscus ME1, the standard position is a position of the meniscus ME1 that coincides with the nozzle surface 27*a* as in FIG. 6A, Tin is the time at which an ink droplet FL1*d* is discharged, Ta is the time at which the meniscus ME1 returns to the standard position after the ink droplet discharge, and Tb is the time at which the meniscus ME1 returns to the standard position after going back into the nozzle 23. When the position of the meniscus ME1 is above the standard position, this indicates that the meniscus ME1 is protruding from the nozzle surface 27*a*, and when the position of the meniscus ME1 is below the standard position, this indicates that the meniscus ME1 is withdrawn into the nozzle surface 27*a*.

With the recording drive pulse P2 as shown in FIG. 10A, the drive frequency 12 is set to the frequency that follows time Tb in FIG. 10D so that even though the nozzle 23 is in an unstable state, the nozzle is not put into a dot omission state by repeated ink droplet discharges. With the pre-process drive pulse P1 as shown in FIGS. 10B and C, the drive frequency f1 is set to the frequency between time Ta and Time Tb in FIG. 10D so that the nozzle in an unstable state is put into a dot omission state by repeated ink droplet discharges. When an ink droplet FL1*d* is repeatedly discharged from the nozzle 23, the meniscus ME1 progressively moves into the nozzles 23, and the meniscus is eventually drawn in up to the deep tapered portion 23*t*. An air bubble AR1 thereby gets into the nozzle 23, and the nozzle 23 goes into a dot omission state.

The drive voltage of the pre-process drive pulse P1 of the drive frequency f1 higher than the drive frequency f2 can be the same as the drive voltage V2 of the recording drive pulse P2 as shown in FIG. 10B, or it can be the drive voltage V1 higher than the drive voltage V2 of the recording drive pulse P2 as shown in FIG. 10C.

The nozzle determination process in the case that the pre-process is performed to increase the drive frequency can be executed according to the flowchart shown in FIG. 8. In S130, the controller 70 preferably performs control on the print head 24 which causes the pre-process drive pulse P1 having the drive frequency f1 to be repeatedly supplied to the drive elements 48, and executes the pre-process for discharging ink FL2 from all of the nozzles 23. The drive frequency f1 can be lowered as the temperature detected by the temperature detector 24*t* increases. Nozzles in an unstable state go into the dot omission state due to the pre-process being executed. After the pre-process, the controller 70 preferably executes the inspection process using the nozzle inspection part U1.

According to the pre-process for discharging ink FL2 with an increased drive frequency, since the nozzle determination process (the inspection process) is performed after the nozzles in an unstable state have gone into a dot omission state, the nozzles in an unstable state undergo maintenance after the nozzle inspection. Since fewer nozzles are in an unstable state after the nozzle inspection, the present aspect also can suppress nozzles in an unstable state from being used in printing.

The pre-process drive pulse P1 supplied to the drive elements 48 in S130 can have a drive frequency f1 higher than the drive frequency f2 of the recording drive pulse P2, and can also have a peak time x with an ink droplet rate v1 raised above the ink droplet rate v2 of the recording drive pulse P2.

(8) Modifications

The embodiment described above can be modified to forms such as those hereinbelow.

The cap 41 described above can be divided into a plurality of boxes for each nozzle row, for example. In this case, an electrode 5 can be provided for each box, and cleaning or another maintenance process can be performed for each box unit. The nozzle inspection can be performed in a flushing area or another area other than the home position, and the electrode 52 can be provided to this area.

Electric change detection unit for detecting electric changes can be configured from a circuit or the like for detecting electric current changes caused by fluid discharged from the nozzles 23.

The process described above can be performed by the host device 10 or another external device connected to a printer. In this case, the nozzle inspection device is provided to the external device, and the fluid discharge device is provided to both the printer and the external device. As shall be apparent, the printer and the external device can cooperatively perform the process described above. In this case, the nozzle inspection device and the fluid discharge device are provided to both the printer and the external device. Specifically, the fluid discharge device of the present invention can be configured from a system that includes the printer and the external device.

The sequence of the steps of the process described above can be suitably varied. In the nozzle inspection process of FIG. 7, for example, the addition process of the counter C of S116 can be performed before the maintenance process of S114.

In the embodiment described above, a detection is performed for two alternatives of whether or not the nozzles are in a normal state, but three or more states can also be detected, such as detecting whether the nozzles are in a normal state, a dot omission state, or an unstable state.

Even in a case in which a computer is used which can read the value of the voltage change ΔV1 detected by the voltage detection circuit 56, whether or not the state of the nozzles 23 is normal can be determined by performing the process described above. Specifically, the present aspect is satisfactorily multi-purpose in that it can be implemented regardless of whether or not the controller can read the value of the voltage change.

The drive voltage, ink droplet rate, drive frequency, and other discharge conditions of the pre-process can be varied according to modes of the drive pulse specified as a high-speed mode, a usual mode, and a high-definition mode; they can be varied according to dot types specified as small dots, medium-sized dots, and large dots; and they can be varied according to ink types specified as C, M, Y, and K. For example, in a case in which printing that emphasizes small dots is performed, when ink droplets that form small dots are discharged, the drive voltage, the ink droplet rate, the drive frequency, and other discharge conditions of the pre-process are preferably set such that nozzles in a normal state are not set in a dot omission state but nozzles in an unstable state are put into a dot omission state.

In addition to a color inkjet printer, the print device can also be a monochromatic machine, a dot impact printer, a laser printer, a multi-function machine including reading means specified as a scanner or a colorimeter, a line printer which conveys a recording medium relative to a print head formed over one length in the width direction of a recording medium to perform printing, and the like. In addition to paper, the recording medium can be a resin sheet, a metal film, cloth, a film substrate, a resin substrate, a semiconductor wafer, a storage medium specified as an optical disk or a magnetic disk, or the like. In addition to a cut sheet, the shape of the recording medium can be rectangular, three-dimensional, or the like.

In addition to a printer, the fluid discharge device to which the present invention can be applied can be a fluid discharge device including a fluid discharge head or the like for ejecting (discharging) droplets in tiny amounts, or another device for discharging fluid other than ink. The term "droplets" used herein refers to the state of the liquid discharged from a liquid discharge device, and includes that which leaves trails of grains, tears, or threads. The liquid referred to herein need only be a substance that can be ejected by the liquid discharge device. The substance is in the state of a liquid, for example, and examples include fluids such as liquids of high and low viscosity, sols, gels, inorganic solvents, organic solvents, solutions, liquid resins, and liquid metals (metal melts). A liquid is one state of the substance, but other examples include liquids containing particles of functional materials composed of pigments, metal particles, or the like which are dissolved, dispersed, or mixed in a solvent. Ink, liquid crystal, and the like are typical examples of the liquid. The aforementioned ink includes common water-based ink and oil-based ink, as well as gel ink, hot melt ink, and other various liquid compositions. Specific examples of the liquid discharge device include devices for discharging a liquid containing an electrode material, a coloring material, or the like in the form of a dispersion or a solvent, which is used in the manufacture of liquid crystal displays, EL (electroluminescence) displays, surface-emitting displays, color filters, and the like. Other examples of the liquid discharge device include devices which discharge a biological organic substance used to manufacture biochips; devices which are used as precision pipettes and which discharge a liquid as a test sample; printing devices, micro dispensers; devices which discharge lubricating oil at pinpoints onto watches, cameras, and other precision instruments; devices which discharge an ultraviolet curing resin or another transparent resin liquid onto a substrate in order to form a microscopic semispherical lens (optical lens) or the like used in an optical communication element or the like; and devices for discharging an acid, an alkali, or another etching liquid in order to etch a substrate or the like.

The fluid is preferably a non-gaseous fluid, but can also be a toner or another particulate substance.

The present invention also includes an aspect in which the inspection process is executed after the pre-process is performed with one nozzle as the target.

As shall be apparent, the essential actions and effects described above are also obtained with a device, a system, a method, a program, and the like not having the constituent elements according to the dependent claims and including only the constituent elements according to the independent claims.

As described above, according to the present invention, it is possible through various aspects to provide a technique or the like fewer nozzles are in an unstable state after the nozzle inspection.

The configurations disclosed in the embodiments and modifications described above can be mutually substituted and the combinations can be modified to implement the present invention, and the configurations disclosed in the well-known techniques as well as in the embodiments and modifications described above can be mutually substituted and the combinations can be modified to implement the present invention. Consequently, the present invention is not limited to the embodiments and modifications described above; it includes configurations resulting from mutually substituting the configurations and varying combinations of the configurations, which are disclosed in the well-known techniques and in the embodiments and modifications described above.

The entire disclosure of Japanese Patent Application No. 2011-105927, which is filed May 11, 2011, is expressly incorporated by reference herein.

What is claimed is:

1. A fluid discharge device comprising:

a discharge head configured to discharge a fluid from nozzle, the discharge head having a drive element that is configured to cause the fluid to be discharged from the nozzle;

a nozzle inspection part configured to inspect a state of discharging of the fluid from the nozzle; and a controller configured to supply a pre-process drive signal to the drive element as a pre-process before executing an inspection process to inspect the state of discharging of the fluid using the nozzle inspection part, such that an unstable nozzle in an unstable state from which the fluid is unstably discharged is set in a dot omission state where discharging of the fluid from the unstable nozzle is avoided during the inspection process, the pre-process drive signal being set such that the fluid is discharged from a stable nozzle while the discharging of the fluid from the unstable nozzle is avoided.

2. The fluid discharge device according to claim 1, wherein the controller supplies a drive pulse as the pre-process drive signal to the drive element, and the drive pulse has a drive voltage higher than a drive voltage of a recording drive pulse used in discharging of the fluid on a recording medium.

3. The fluid discharge device according to claim 1, wherein the controller supplies a drive pulse as the pre-process drive signal to the drive element, and the drive pulse is supplied to the drive element such that the fluid is discharged at a higher rate than a rate of the fluid discharged on a recording medium.

4. The fluid discharge device according to claim 1, wherein the controller supplies a drive pulse as the pre-process drive signal to the drive element, and the drive pulse has a drive frequency higher than a drive frequency of a recording drive pulse used in the fluid discharge on a recording medium.

5. The fluid discharge device according to claim 1, wherein the pre-process drive signal changes according to an environment of the discharge head.

6. A nozzle inspection method for discharging fluid from nozzle provided to a discharge head of a fluid discharge device, and inspecting a state of discharging of the fluid from the nozzle, comprising:

supplying a pre-process drive signal to a drive element, which the discharge head has and is configured to cause the fluid to be discharged from the nozzle, as a pre-process before executing an inspection process to inspect the state of discharging of the fluid, such that an unstable nozzle in an unstable state from which the fluid is unstably discharged is set in a dot omission state where discharging of the fluid from the unstable nozzle is avoided during the inspection process, the pre-process drive signal being set such that the fluid is discharged from a stable nozzle while the discharging of the fluid from the unstable nozzle is avoided.

7. A non-transitory computer-readable medium on which is recorded a nozzle inspection program for discharging a fluid from nozzle provided to a discharge head of a fluid discharge device, and inspecting a state of discharging the fluid from the nozzle, the non-transitory computer-readable medium causing a computer to perform function of:

supplying a pre-process drive signal to a drive element, which the discharge head has and is configured to cause the fluid to be discharged from the nozzle, as a pre-process before executing an inspection process to inspect the state of discharging of the fluid, such that an unstable nozzle in an unstable state from which the fluid is unstably discharged is set in a dot omission state where discharging of the fluid from the unstable nozzle is avoided during the inspection process, the pre-process drive signal being set such that the fluid is discharged from a stable nozzle while the discharging of the fluid from the unstable nozzle is avoided.

* * * * *